US006074085A

United States Patent [19]

Scarpa et al.

[11] Patent Number: 6,074,085

[45] Date of Patent: Jun. 13, 2000

[54] CYCLONIC MIXER

[75] Inventors: Jack Scarpa; Terry Hall, both of Huntsville; David D. Mathias, Athens, all of Ala.

[73] Assignee: USBI Co., Cape Kennedy, Fla.

[21] Appl. No.: 08/995,429

[22] Filed: Dec. 20, 1997

(Under 37 CFR 1.47)

[51] Int. Cl.[7] ..... B01F 13/02

[52] U.S. Cl. ..... 366/101; 366/165.5; 366/178.2; 406/88; 406/92

[58] Field of Search ..... 366/101, 107, 366/165.1, 178.1, 178.2, 178.3, 181.6, 191, 336, 340, 341, 165.5; 406/86, 88, 89, 92; 222/195

[56] References Cited

U.S. PATENT DOCUMENTS

| | | | |
|---|---|---|---|
| 1,051,905 | 2/1913 | McCord . | |
| 2,307,509 | 1/1943 | Joachim et al. | 366/178.2 |
| 2,747,844 | 5/1956 | Slayter | 366/178.2 |
| 2,784,948 | 3/1957 | Pahl et al. | 366/178.2 |
| 2,951,061 | 8/1960 | Gomory | 366/181.6 |
| 3,147,955 | 9/1964 | Harvey et al. | 366/165.1 |
| 3,471,203 | 10/1969 | Farnworth . | |
| 3,818,938 | 6/1974 | Carson | 366/178.2 |
| 4,095,847 | 6/1978 | Wear . | |
| 4,207,007 | 6/1980 | Yamschikov et al. | 366/341 |
| 4,230,410 | 10/1980 | Kastl et al. | 366/178.2 |
| 4,761,077 | 8/1988 | Werner | 366/165.1 |
| 5,307,992 | 5/1994 | Hall et al. . | |
| 5,338,113 | 8/1994 | Fissenko | 366/178.3 |
| 5,492,404 | 2/1996 | Smith | 366/178.3 |
| 5,565,241 | 10/1996 | Mathias et al. . | |
| 5,579,998 | 12/1996 | Hall et al. . | |
| 5,722,802 | 3/1998 | March | 406/89 |

FOREIGN PATENT DOCUMENTS

| | | | |
|---|---|---|---|
| 211685 | 2/1987 | European Pat. Off. | 366/165.1 |
| 1144090 | 2/1963 | Germany | 366/165.1 |
| 59-112830 | 6/1984 | Japan | 366/178.1 |
| 59-203628 | 11/1984 | Japan | 366/101 |
| 633574 | 11/1978 | U.S.S.R. | 366/101 |
| 1404101 | 6/1988 | U.S.S.R. | 366/165.1 |
| 1609250 | 9/1991 | U.S.S.R. | 366/107 |

*Primary Examiner*—Charles E. Cooley
*Attorney, Agent, or Firm*—Norman Friedland

[57] ABSTRACT

A pair of concentric tubes having an inlet and an outlet with the outer tube being closed at either end and the inner tube having a plurality of holes with compound angles designed to impart a swirling motion of the air admitted into the interior of the inner mixing tube. The holes are judiciously located around the inner tube for creating a swirling pattern. The inlet of the tubes leads the dry particles of two different compositions intended to be mixed into the mixer and the outlet leads the mixture to the next station utilizing the mixture. Air admitted internally of the outer tube feed the plurality of holes and the force of the air can be controlled to control the transport of the mixed particles.

5 Claims, 3 Drawing Sheets

CYCLONIC MIXER

TECHNICAL FIELD

This invention relates to mixers and particularly to mixers that mix at least two dry powder or granular material and transport them by the judicious insertion of air jets located in the mixer casing.

BACKGROUND OF THE INVENTION

As is well known to one skilled in the art of formulating and applying coatings it is desirable to introduce reinforcing material such as cork, glass, etc. or metallic powder or granular or other composition filler materials in a coating applied to the surface of a substrate. For example, U.S. Pat. No. 5,565,241 granted to Mathias et al on Oct. 15, 1996 entitled "Convergent End-Effector" having common co-inventors and a common assignee of this patent application relates to a spray gun for coating materials on the surface of a substrate. This type of spray gun and the coating includes reinforcing material (cork and glass) added to a liquid resin in a convergent stream formed by the end-effector. In this method of applying the coating the glass and cork are transported by air to the end-effector where it mixes with the liquid resin downstream of the end-effector's nozzle. Each of the reinforcing materials are individually transported from the eductor and mixed prior to being introduced to the liquid resin. This invention is particularly directed to the mixing aspects of the components and particularly to an efficient, sturdy and long lasting mixer that not only mixes the components but has the capability of transporting the mixed components through the mixer to the next station where it is intended to be utilized.

DISCLOSURE OF THE INVENTION

An object of this invention is to provide an improved mixer for mixing at least two different dry particles.

A feature of this invention is to provide a mixer comprising a pair of concentric tubes with inlets and outlets where the inner tube includes a plurality of discrete holes disposed in a judicious pattern for injecting air from holes formed in the inner tube to create a helical flow pattern for effecting mixing of the two different components. The system contemplates in one embodiment where the particles of the two components are transported independent of the mixing air and a second embodiment where the mixing air is the sole mechanism for transporting the mixed particles. While in the first embodiment the particles are delivered to the mixer in a flow stream being transported by compressed air, the mixing air injected by the mixing holes contributes to the transporting of the mixture.

Another feature of this invention is the utilization of mixing holes that are judiciously disposed and include compound angles to impart a swirling motion to the incoming air prior to being introduced into the body of the mixer.

The foregoing and other features of the present invention will become more apparent from the following description and accompanying drawings.

These figures merely serve to further clarify and illustrate the present invention and are not intended to limit the scope thereof.

BEST MODE FOR CARRYING OUT THE INVENTION

While this invention is being described for use with an end effector of the convergent spray technology as disclosed in U.S. Pat. No. 5,565,241, supra, U.S. Pat. Nos. 5,579,998 and 5,307,992 granted to Hall et al naming the common co-inventors of this U.S. Pat. No. 5,307,992 and which are all commonly assigned and which are incorporated herein by reference, it is to be understood that this invention has particular utility for any application where it is desirable to transport and mix at least two different dry particle or granular ingredients. As is described in the aforementioned patents the use of the mixer of this invention is particularly efficacious in applications of the convergent spray gun where fillers are injected into the liquid convergent spray produced by the end-effector prior to being applied to the surface of the substrate.

Figure 1:
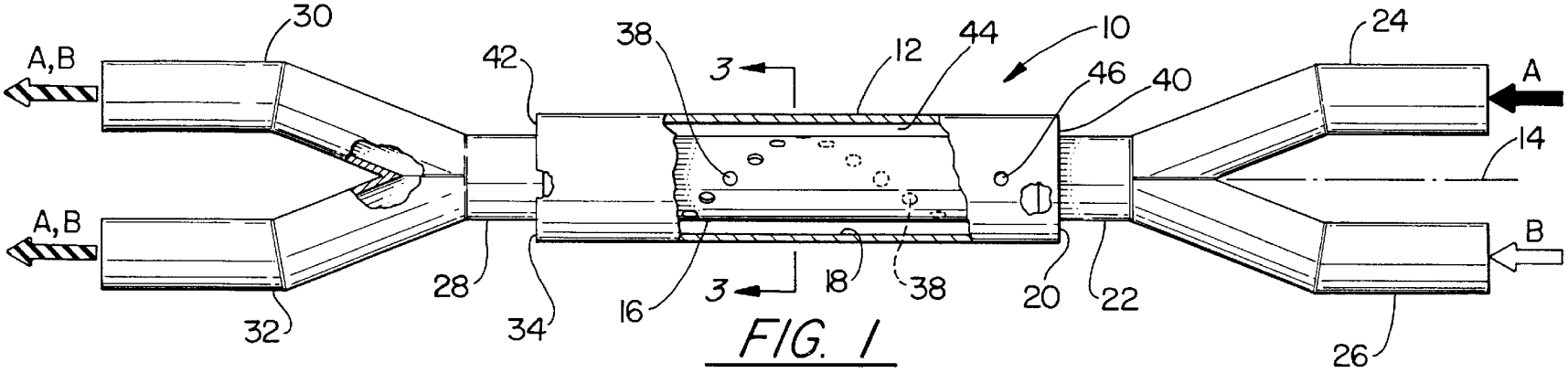
FIG. 1 is a cut-away view partly in section and partly in elevation illustrating the details of this invention.
Figure 2:
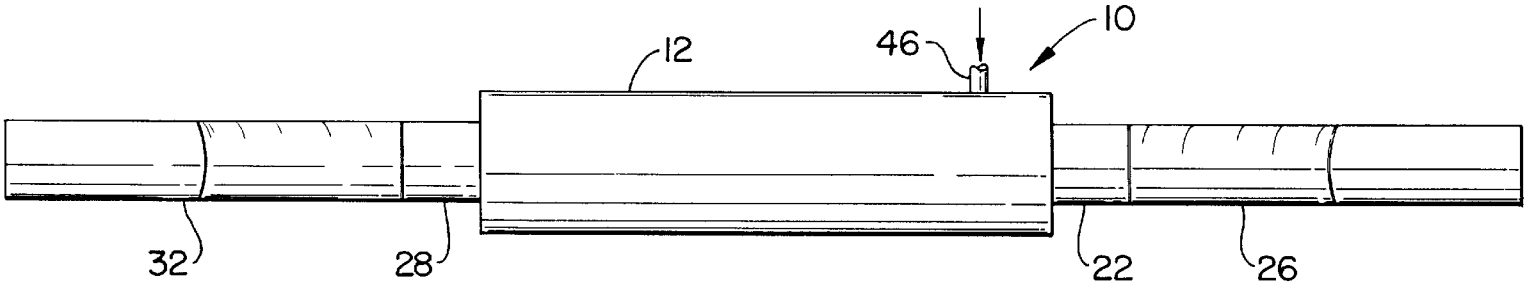
FIG. 2 is a plan side view of FIG. 1.

For an understanding of this invention reference is made to all the Figs. that show the mixer generally illustrated by reference numeral 10 having a cylindrical or tube outer housing 12 surrounding and being concentric and coaxial relative to the center line 14 with the inner cylindrical or tube inner housing 16. The outer housing 12 provides a straight through central passage 18 and is fitted at the inlet end 20 in any suitable manner with a tube 22 that is bifuircated to include a pair of branch lines 24 and 26. A similar tube 28 with branch lines 30 and 32 are suitably fitted at the discharge end 34 of the outer housing 12. As illustrated in FIG. 1 the ingredients A and B are admitted into the mixer 10 and are transported by air and in certain applications the air is sufficient to transport the ingredients into and out of the mixer and to the ultimate destination of the mixed ingredients. In the application where this transport is not sufficient to transport the mixed ingredients to the ultimate destination the air used for mixing will serve this purpose as will be described in further detail herein below.

Figure 3:
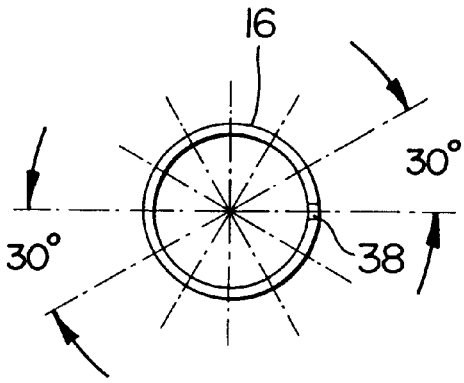
FIG. 3 is a sectional view taken along the lines 3—3 of FIG. 1.
Figure 5:
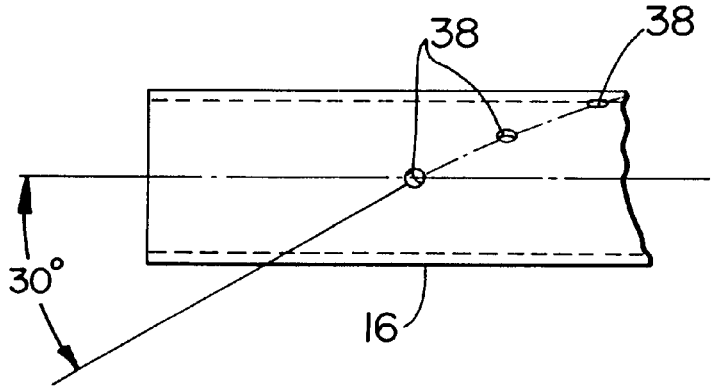
FIG. 5 is a partial view illustrating the critical dimensions of the mixer for a given mixer size.
Figure 4:
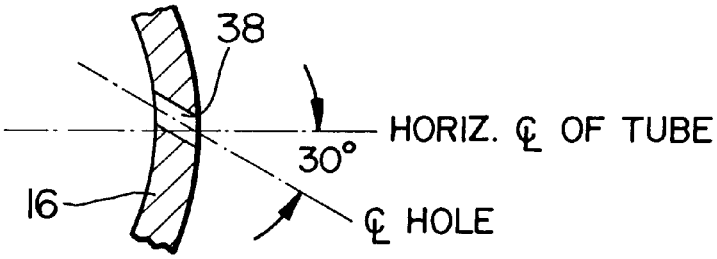
FIG. 4 is a partial view enlarging the mixing hole to illustrate the compound angle of the mixing hole of this invention.

As best seen in FIG. 1 the inner tube includes a plurality of holes 38 that are critically formed and located in order to obtain the desired mixing characteristics of mixer 10. As noted above the holes are formed with compound angles and as seen in FIG. 3 the angle in one plane is substantially 30 degrees (°) relative to the horizontal axis taken through center line 14 and include ten (10) holes around the circumference of tube 16 and are spaced substantially 0.88 inches apart in the tube 16 which is substantially 12.75 inches in length. The other compound angle is shown in FIG. 5 where the angle of the hole is substantially equal to 30° relative to the center line 14. In the preferred embodiment the first hole of holes 38 closest to the inlet 20 is spaced substantially 2.05 inches therefrom and the last hole of holes 38 closest to the outlet 34 is substantially 2.50 inches therefrom.

Figure 6:
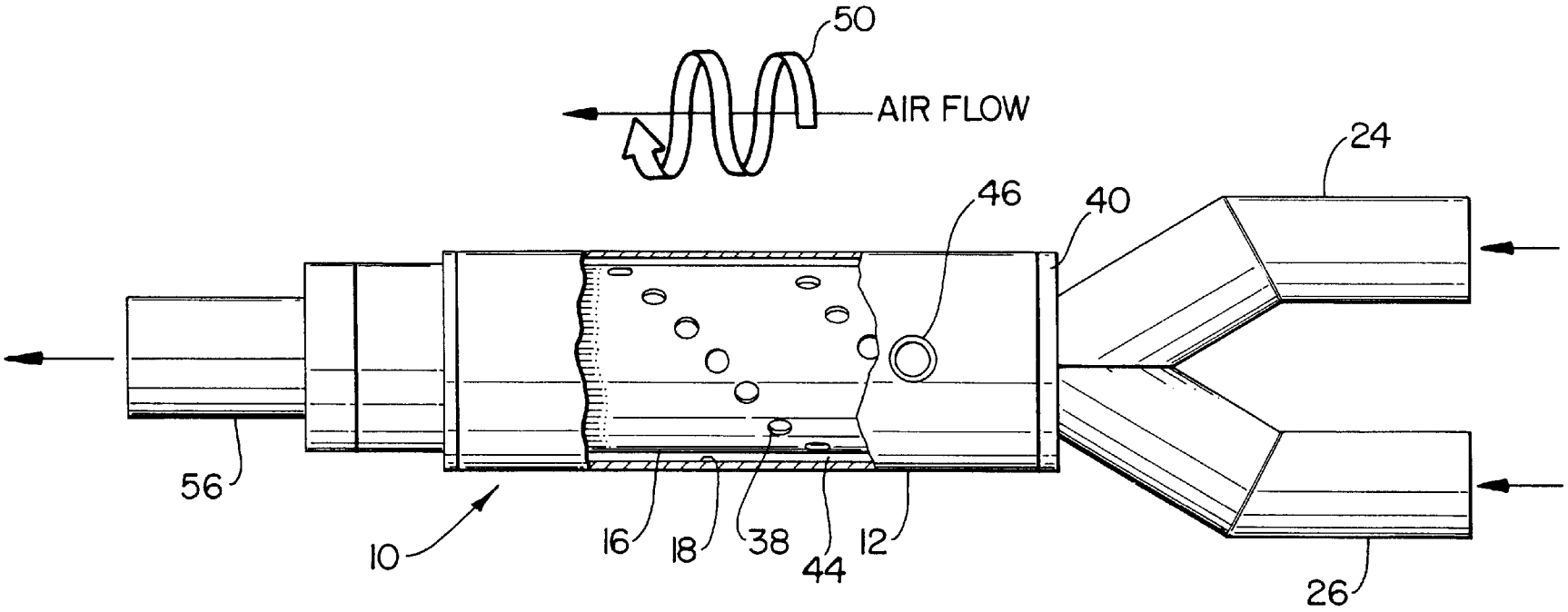
FIG. 6 is another embodiment having the same mixer with a single exit for the mixed components.

The holes are therefor disposed in the inner housing 16 to define a helical path extending from adjacent the inlet of the inner housing towards the outlet of the inner housing as shown in FIGS. 1 and 6.

The inlet end and outlet end of the outer tube 12 are closed off by suitable inserts 40 and 42 respectively and define with the outer surface of inner tube 16 an annular cavity 44 that receives air from the inlet pipe 46. The air inlet pipe 46 is attached to the outer housing adjacent to but spaced upstream from the first aperture of the plurality of apertures for admitting air into the cavity 44 as shown in FIGS. 1 and 6. The air admitted into the cavity 44 serves to supply air under pressure to each of the holes 38. The compound angle of each of the holes 38 is selected to impart a swirling motion to the incoming air as it is discharged internally into the center of tube 16. The spacing of the holes 38 around the circumference of the tube 16 serve to provide a helical path to the air as represented by the arrow 50 as it progresses from the inlet 20 to the exit 34 of mixer 10. This provides an efficacious mixer for the two ingredients that are mixed within mixer 10 and transported through pipe 30 to the end-effector (not shown).

As it is apparent from the foregoing the pressure of the mixing air can be selected to provide the transporting force of the mixed ingredients from the mixer to the next station. For example, the powder ingredients can be introduced through hoppers or other well known feeders directly into the interior of mixer 10 and the mixing air inserter through holes 38 would not only provide the mixing but would also provide the medium to transport the mixed ingredients.

FIG. 6 exemplifies another embodiment where the cyclonic mixer 10 is identical to the cyclonic mixer depicted in FIG. 1 except that the mixed components exit in the single discharge conduit 56. As shown by the arrow 50 the cyclonic mixer serves to impart a helical motion to the mixed stream and conducts the stream from the entrance to the exit. Obviously, in applications where the components are not fed to the mixer by some transport mechanism, the mixer itself can utilize a pressurized source to effectuate the motion.

Although this invention has been shown and described with respect to detailed embodiments thereof, it will be appreciated and understood by those skilled in the art that various changes in form and detail thereof may be made without departing from the spirit and scope of the claimed invention.

It is claimed:

1. A mixer for mixing at least two different ingredients that are in the form of dry powder or granular including an outer housing having a straight through passage, an inner housing within said outer housing having a straight through passage and being radially spaced from said outer housing for defining an annular passage and having an inlet and an outlet, means for closing off the ends of said annular passage to define a cavity for receiving mixing air, a plurality of apertures formed in said inner housing for admitting air in said straight through passage of said inner housing and each having a contour for imparting a swirling motion to the air passing therethrough, said plurality of apertures being disposed in said inner housing to define a helical path extending from adjacent to the inlet towards the outlet of said straight through passage of said inner housing, an air inlet attached to the outer housing and disposed adjacent to but spaced upstream from the first aperture of said plurality of apertures for admitting air into said cavity and means for admitting said two different ingredients into said inlet of said inner housing.

2. A mixer for mixing at least two different ingredients as claimed in claim 1 wherein said inner housing is a tube.

3. A mixer for mixing at least two different ingredients as claimed in claim 2 wherein said apertures are formed with compound angles.

4. A mixer for mixing at least two different ingredients as claimed in claim 3 wherein the apertures as equally spaced around the circumference in a helical pattern.

5. A mixer as claimed in claim 1 wherein said apertures are formed with compound angles, said apertures are 30° relative to the horizontal axis of said mixer and lie within a plane that is 30° relative to the horizontal axis and the apertures are evenly spaced around the circumference of said inner housing in a helical pattern.

* * * * *